US005438182A

United States Patent [19]

Choi

[11] Patent Number: 5,438,182

[45] Date of Patent: Aug. 1, 1995

[54] CHOKE COIL APPARATUS FOR AN ELECTROMAGNETIC RANGE

[75] Inventor: Byoung T. Choi, Kyung Sang Buk-do, Rep. of Korea

[73] Assignee: Gold Star Co., Ltd., Seoul, Rep. of Korea

[21] Appl. No.: 933,681

[22] Filed: Aug. 24, 1992

[30] Foreign Application Priority Data

Aug. 22, 1991 [KR] Rep. of Korea ..... 91-14459

[51] Int. Cl.[6] ..... H05B 6/66; H01F 27/08; H01F 27/24

[52] U.S. Cl. ..... 219/702; 219/761; 336/60; 336/212; 336/233

[58] Field of Search ..... 336/60, 55, 83, 233, 336/212, 221; 219/702, 761

[56] References Cited

U.S. PATENT DOCUMENTS

| | | | |
|---|---|---|---|
| 499,852 | 6/1893 | Pfannkuche | 336/83 |
| 1,436,901 | 11/1922 | Patch | 336/60 |
| 3,835,430 | 9/1974 | Kocsis | 336/83 |
| 5,034,716 | 7/1991 | Mokadom | 336/60 |

FOREIGN PATENT DOCUMENTS

| | | | |
|---|---|---|---|
| 507436 | 12/1951 | Belgium | 336/60 |
| 630070 | 11/1927 | France | 336/60 |
| 134181 | 9/1929 | Switzerland | 336/60 |

*Primary Examiner*—Thomas J. Kozma
*Attorney, Agent, or Firm*—Keck, Mahin & Cate

[57] ABSTRACT

A choke coil apparatus for an electromagnetic range comprises an improved ferrite core, so as to prevent an increasing in temperature of the choke coil. The ferrite core in a multiangular bar-shape forms a plurality of ventilation spaces between the choke coil and the ferrite core, thereby air-cooling the choke coil by the air flowing in the ventilation space.

14 Claims, 4 Drawing Sheets

CHOKE COIL APPARATUS FOR AN ELECTROMAGNETIC RANGE

BACKGROUND OF THE INVENTION

The present invention relates to a filter circuit for removing noise of a high frequency component in a magnetron for an electromagnetic range or microwave oven, and more particularly to a choke coil apparatus having an improved ferrite core which can restrain the increase in temperature of a choke coil.

A conventional magnetron for an electromagnetic range comprises an oscillator 10 for generating an electromagnetic wave signal of high frequency, and a filter circuit 30 connected between the oscillator 10 and a power source (not shown) for restraning the transmission to the power source of the high frequency signal generated in the oscillator 10, as shown in FIG. 1.

The oscillator 10 comprises a cylindrical anode 13 installed in upper and lower yokes 11 and 12, and a filament 14 installed on a central axis of the anode 13. A plurality of vanes 15 extended toward the filament 14 from the inner circumferential surface of the anode 13 are radially installed in the inner circumferential surface of the anode 13. Further, a plurality of cooling pins 16 extended from the outer circumferential surface of the anode 13 to the inner circumferential surface of the lower yoke 12 are installed in the outer circumferential surface of the anode 13. The cooling pins 16 externally emit the heat in the anode 13 by a thermion generated in the filament 14. Furthermore, the magnetic poles 17 and 18 extended toward the upper and lower ends of the filament 14 are respectively installed in the upper and lower ends of the anode 13. The oscillator 10 comprises permanent magnets 19 and 20 installed in the upper and lower portions of the magnetic poles 17 and 18, respectively, a center lead 21 extended from the upper end of the filament 14 to the filter circuit 30, and a side lead 22 extended from the lower end of the filament 14 to the filter circuit 30. The center lead 21 and the side lead 22 transmit to the filament 14 the operating voltage supplied via the filter circuit 30 from the external power source.

The filter circuit 30 comprises a filter box 31 and a lead through capacitor 32 installed in the side wall of the filter box 31 so as to pass through the side wall of the filter box 31, as shown in FIGS. 1 and 2. The capacitor 32 comprises first and second connecting terminals formed on the outside exposed portion of the filter box 31 for receiving a power source, and third and fourth connecting terminals formed on the inside portion of the filter box 31. The third and fourth connecting terminals of the capacitor 32 are respectively connected to the right ends of the choke coils 33 and 35. The center lead 21 and the side lead 22 are respectively connected to the other ends of the choke coils 33 and 35. Further, ferrite cores 34 and 36 are respectively inserted into the choke coils 33 and 35. The ferrite cores 34 and 36 are in the form of circular bars, as shown in FIG. 3.

The magnetron formed as described above operates as follows. The electron generated in the filament 14 is rotated by the magnetic field of the permanent magnets positioned on the upper and lower portions of the magnetic poles and moved to the anode 13. At this time, the electrons which are being moved form several rotating electron poles to allow the anode 13 to perform a very high frequency oscillation. The very high frequency components generated by the anode 13 are supplied to the choke coils 33 and 35 of the filter circuit 30 through a filament 14, a center lead 21, and a side lead 22. The very high frequency components supplied to the choke coils 33 and 35 is removed by the lead through capacitor 32 forming a low-pass filter together with the choke coils 33 and 35, so that it is not transmitted to the power source connected to the first and second connecting terminals of the lead through capacitor 32.

However, as the filament 14 is heated, the choke coils 33 and 35 are heated by the heat generated in the filament 14 and supplied through the center and side leads 21 and 22. Accordingly, there is a problem in that the choke coils 33 and 35 burn or the ferrite cores 34 and 36 are broken, due to the heating of the choke coils 33 and 35.

SUMMARY OF THE INVENTION

Accordingly, it is an object of the present invention to provide a choke coil apparatus for an electromagnetic range having an improved ferrite core which can prevent damage in the choke coil and ferrite core.

To achieve the object, the present choke coil apparatus for an electromagnetic range comprises a choke coil, and a multiangular bar-shaped ferrite core inserted in the choke coil for forming a plurality of ventilation spaces.

BRIEF DESCRIPTION OF THE DRAWINGS

The above object and other advantages of the present invention will become more apparent by describing the preferred embodiments of the present invention with reference to the attached drawings, in which.

DETAILED DESCRIPTION OF THE INVENTION

Figure 1:
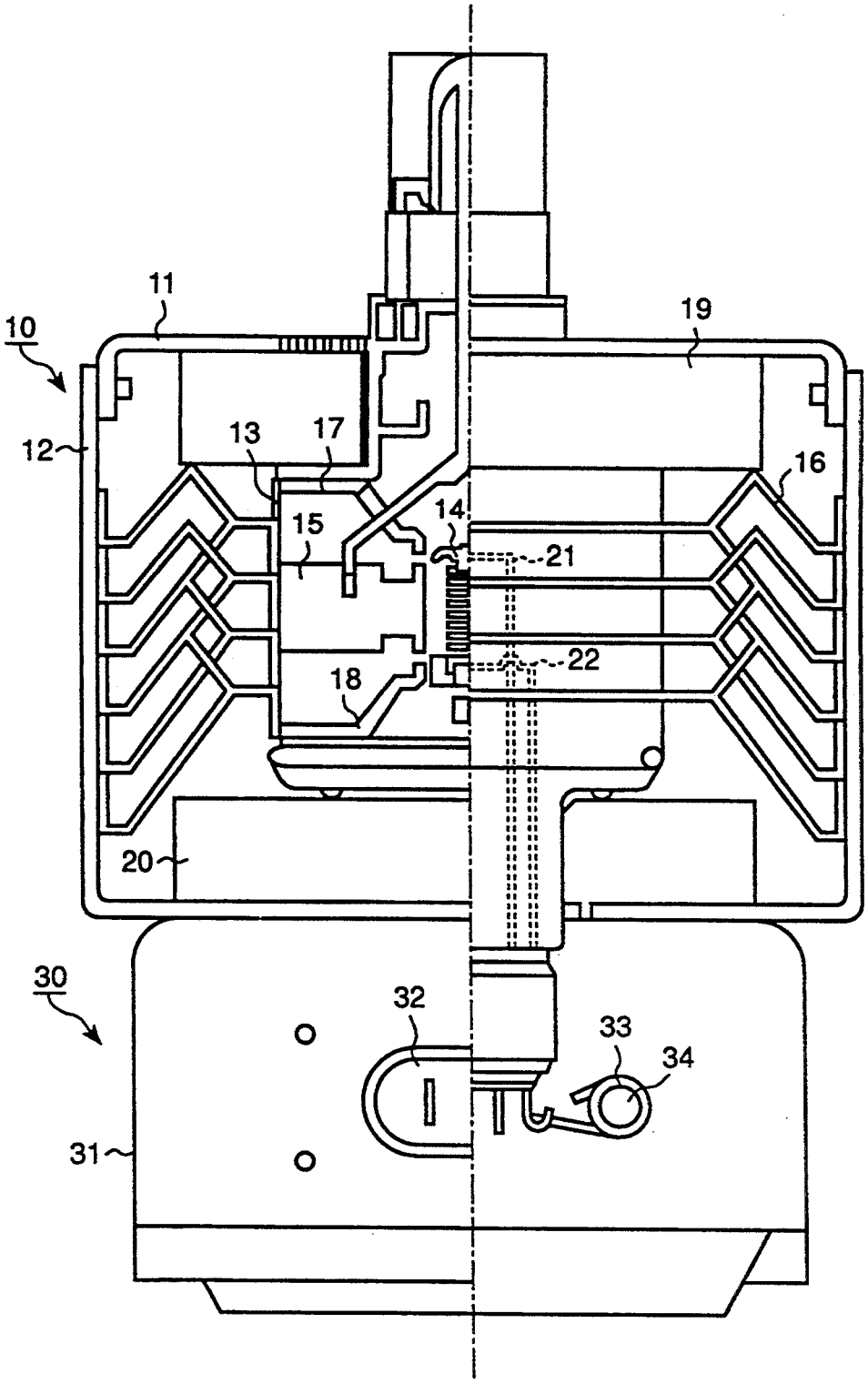
FIG. 1 (PRIOR ART)
FIG. 1 is a sectional view of the principal part of the magnetron for an electromagnetic range.
Figure 2:
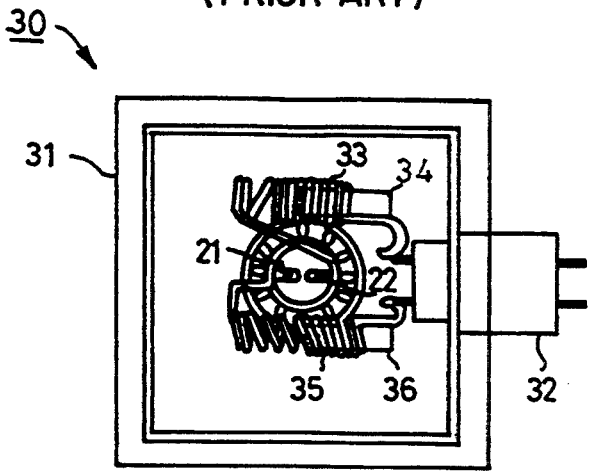
FIG. 2 (PRIOR ART)
FIG. 2 is a plan view of the filter circuit shown in FIG. 1.
Figure 3:
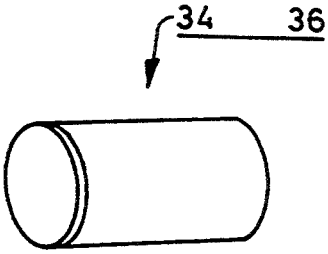
FIG. 3 (PRIOR ART)
FIG. 3 is a perspective view of a conventional ferrite core.
Figure 4:
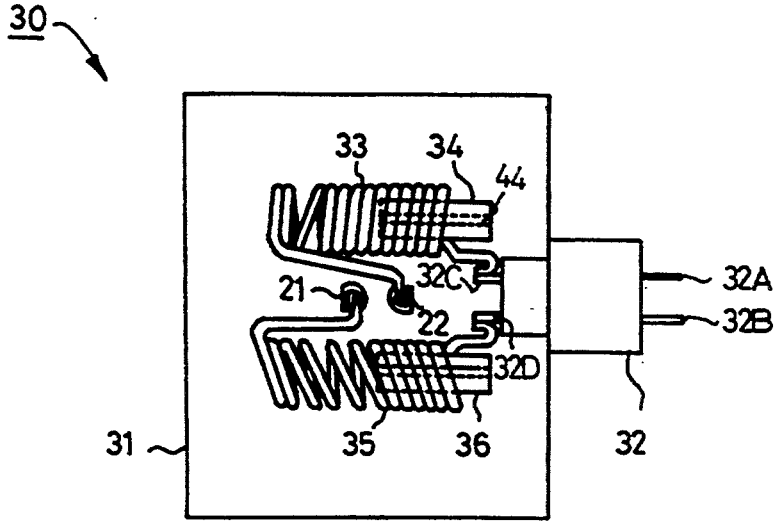
FIG. 4 is a plan view of the filter circuit having a choke coil apparatus according to an embodiment of the present invention.

Referring to FIG. 4, there is shown a filter circuit 30 to which a choke coil apparatus is applied, according to an embodiment of the present invention comprising a lead through capacitor 32 installed in the side wall of a filter box 31. The lead through capacitor 32 comprises first and second connecting terminals 32A and 32B for obtaining a voltage from an external power source (not shown). The lead through capacitor 32 comprises a third connecting terminal 32C connected to one end of a first choke coil 33 and a fourth connecting terminal 32D connected to one end of a second choke coil 35. The first and second connecting terminals 32A and 32B of the lead through capacitor 32 are connected to the third and fourth connecting terminals 32C and 32D, respectively. The other end of the first choke coil 33 is connected to the center lead 21 shown in FIG. 1. The other end of the second choke coil 35 is connected to the side lead 22 shown in FIG. 1. The filter circuit 30 further comprises a first ferrite core 34 inserted into the first choke coil 33 and a second ferrite core 36 inserted into the second choke coil 35. The first and second ferrite cores 34 and 36 are in a multiangular bar shape and form a plurality of ventilation spaces 60 (shown in FIG. 5C) between the choke coils 33 and 35. The air flowing through the ventilation space 60 air-cools the choke coils 33 and 35, thereby preventing the choke coils 33 and 35 from being heated above a predetermined temperature. The ferrite cores 34 and 36 comprise a ventilation hole or passing hole 44 going through both end walls and formed in the longitudinal direction, so as to increase its radiation efficiency.

The multiangular ferrite cores 34 and 36 having the passing hole 44 generate a decreased magnetic passage area of magnetic flux due to the formation change and the formation of the passing hole, thereby reducing the inductances of the choke coils 33 and 35. The lengths of the ferrite cores 34 and 36 inserted in the choke coils 33 and 35 are increased to compensate the reduced inductance of the choke coils 33 and 35. In this case, the winding numbers of the choke coils 33 and 35 wound in the ferrite cores 34 and 36 are increased, so that the inductance L of the choke coils 33 and 35 is increased according to the following formula.

$$L=N\Phi/i \qquad (H)$$

Here, N is the winding number of the choke coil, Φ is the magnetic flux, and i is the current flowing in the choke coil.

Figure 5B:
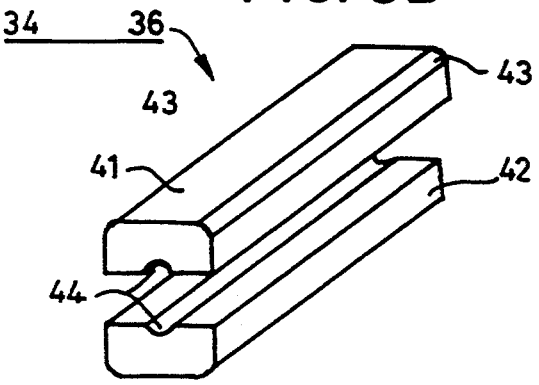
FIG. 5B is a separate perspective view of the ferrite core shown in FIG. 5A.
Figure 5A:
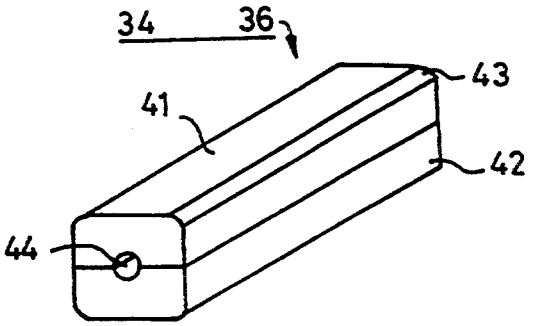
FIG. 5A is a perspective view for explaining the embodiment of the ferrite core shown in FIG. 4.
Figure 5C:
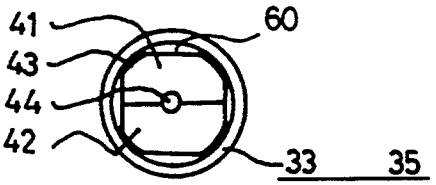
FIG. 5C is a side view of the choke coil in FIG. 4 into which the ferrite core in FIG. 5A is inserted.

FIGS. 5A and 5B are a perspective view and a separate perspective view, respectively, illustrating an embodiment of the ferrite cores 34 and 36 having a rectangular bar shape, which are shown in FIG. 4. FIG. 5C is a side view where the ferrite cores 34 and 36 shown in FIG. 5A are inserted into the choke coils 33 and 35 shown in FIG. 4. Referring to FIGS. 5A to 5C, the rectangular ferrite cores 34 and 36 comprise a passing hole 44 formed in the longitudinal direction, and rounding portions 43 formed on their edge portions for facilitating the insertion into the choke coils 33 and 35. The rectangular bar shaped ferrite cores 34 and 36 are divided along the passing hole 44 at their centers into two bodies 41 and 42. The rounding portions 43 have circular arcs corresponding to the diameter of the choke coils 33 and 35. Four ventilation spaces 60 are formed between the choke coils 33 and 35 and ferrite cores 34 and 36.

Figure 6A:
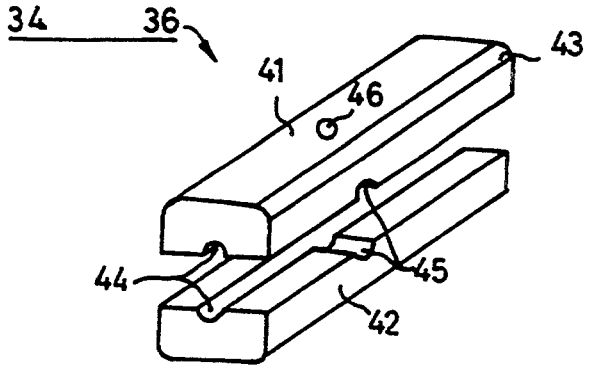
FIG. 6A is a separate perspective view for explaining another embodiment of the ferrite core shown in FIG. 5A.

FIG. 6A is an exploded perspective view showing another embodiment of the rectangular ferrite cores 34 and 36 in FIG. 5A. Referring to FIG. 6A, the rectangular ferrite cores 34 and 36 additionally comprise two passing holes 45 and 46 (absent in the ferrite cores shown in FIG. 5A) so as to increase their radiation efficiency. The first passing hole 44 passes through the both side center portions of the ferrite cores 34 and 36, and is formed in the longitudinal direction of the ferrite cores 34 and 36. The second passing hole 45 is (horizontally) perpendicular to the first passing hole 44 and passes through the front and rear surfaces of the ferrite cores 34 and 36. Finally, the third passing hole 46 passes through the upper and lower surfaces of the ferrite cores 34 and 36 perpendicular to the first and second passing holes 44 and 45. As a result, the three passing holes 44 to 46 are formed radially from the central point of the ferrite cores 34 and 36.

Figure 6B:
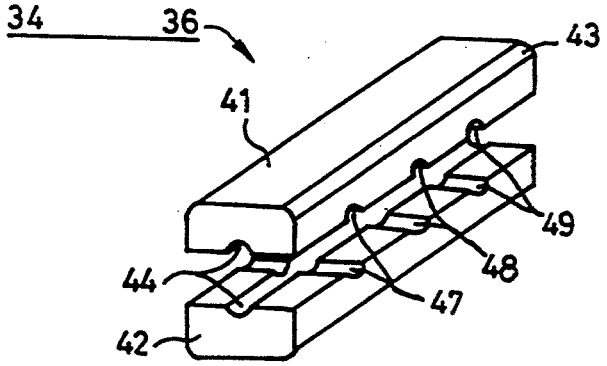
FIG. 6B is a separate perspective view for explaining still another embodiment of the ferrite core shown in FIG. 5A.

FIG. 6B is an exploded perspective view for explaining still another embodiment of the rectangular ferrite cores 34 and 36 shown in FIG. 5A. Referring to FIG. 6B, the rectangular ferrite cores 34 and 36 additionally comprise three passing holes 47 to 49, so as to increase their radiation efficiency. The first passing hole 44 passes through the central portion of both end walls of the ferrite cores 34 and 36, and is formed in the longitudinal direction of the cores 34 and 36. The second to fourth passing holes 47 to 49 are formed to pass through the front and rear surfaces of the rectangular ferrite cores 34 and 36, (horizontally) perpendicular to the first passing hole 44. The second to fourth passing holes 47 to 49 are arranged in parallel separated by predetermined intervals.

Figure 7:
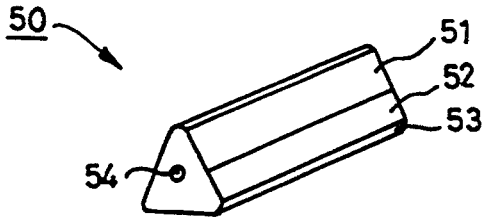
FIG. 7 is a perspective view for explaining another embodiment of the ferrite core shown in FIG. 4.

Referring to FIG. 7, a ferrite core 50 of a triangular bar shape according to a second embodiment of the ferrite cores 34 and 36 shown in FIG. 4 is shown. The triangular ferrite core 50 comprises a passing hole 54 to improve its radiation efficiency. The passing hole 54 passes through both end walls of the triangular ferrite core 50, and is formed in the longitudinal direction of the core 50. The triangular ferrite core 50 comprises round portions 53 formed at the edge portions to facilitate insertion into the choke coils 33 and 35 shown in FIG. 4. Also, the triangular ferrite core 50 is divided, along the passing hole 54, into two bodies 51 and 52, which are separated so as to easily form the passing hole 54. The triangular ferrite core 50 formed as described above is inserted into the choke coils 33 and 35 shown in FIG. 4 to form three ventilation spaces between the choke coils 33 and 35 and the ferrite core 50, thereby air-cooling the choke coils 33 and 35.

As described above, the present invention has an advantage in that the ferrite core inserted into the choke coil is formed in a multiangular bar shape to form a ventilation spaces between the choke coil and the ferrite core, thereby air-cooling the choke coil and ferrite core. Also, a passing hole for ventilation is formed in the ferrite core, thereby providing the advantage of increasing the radiation efficiency of the ferrite core. These advantages prevent the burning of the choke coil and the breaking of the ferrite core.

What is claimed is:

1. An electromagnetic range or microwave oven comprising an oscillator including a magnetron for generating an electromagnetic wave signal of high frequency and a filter circuit including a choke coil and a condenser connected between the oscillator and a power source therefor, a ferrite core inserted into said choke coil, said ferrite core having a multiangular bar shape to provide a plurality of ventilation spaces between said ferrite core and said choke coil, having its edges formed as rounding portions having a circular arc corresponding to the inner diameter of the choke coil, having at least one passing hole so as to improve its radiation efficiency, and being composed of at least two divided bodies so as to easily form said passing hole.

2. An apparatus as claimed in claim 1, characterized in that said at least one passing hole is formed radially from the center point of said multiangular bar-shaped ferrite core.

3. An apparatus as claimed in claim 1, characterized in that said multiangular bar shape is a triangular bar shape.

4. An apparatus as claimed in claim 1, characterized in that said multiangular bar shape is a rectangular bar shape.

5. An apparatus as claimed in claim 4, characterized in that the at least one passing hole in said rectangular bar-shaped ferrite core comprises a first passing hole formed in the longitudinal direction thereof so as to improve its radiation efficiency.

6. An apparatus as claimed in claim 5, characterized in that said rectangular bar-shaped ferrite core further comprises a plurality of passing holes perpendicular to said first passing hole of said longitudinal direction, separated by predetermined intervals.

7. An apparatus as claimed in claim 4, characterized in that said rectangular ferrite core comprises a plurality of passing holes radially formed from its center portion so as to improve its radiation efficiency.

8. A choke coil apparatus for use in an electromagnetic range or microwave oven that includes an oscillator including a magnetron for generating an electromagnetic wave signal of high frequency and a filter circuit including a choke coil and a condenser connected between the oscillator and a power source therefor, comprising a choke coil and a ferrite core inserted into said choke coil, said ferrite core having a multiangular bar shape to provide a plurality of ventilation spaces between said ferrite core and said choke coil and, having its edges formed as rounding portions having a circular arc corresponding to the inner diameter of the choke coil, having at least one passing hole so as to improve its radiation efficiency, and being composed of at least two divided bodies so as to easily form said passing hole.

9. An apparatus as claimed in claim 8, characterized in that said at least one passing hole is formed radially from the center point of said multiangular bar-shaped ferrite core.

10. An apparatus as claimed in claim 8, characterized in that said multiangular bar shaped is a triangular bar shape.

11. An apparatus as claimed in claim 8, characterized in that said multiangular bar shape is a rectangular bar shape.

12. An apparatus as claimed in claim 11, characterized in that the at least one passing hole in said rectangular bar-shaped ferrite core comprises a first passing hole formed in the longitudinal direction thereof so as to improve its radiation efficiency.

13. An apparatus as claimed in claim 12, characterized in that said rectangular bar-shaped ferrite core further comprises a plurality of passing holes perpendicular to said first passing hole of said longitudinal direction, separated by predetermined intervals.

14. An apparatus as claimed in claim 11, characterized in that said rectangular ferrite core comprises a plurality of passing holes radially formed from its center portion so as to improve its radiation efficiency.

* * * * *